United States Patent [19]

Amboss

[11] Patent Number: 4,668,893

[45] Date of Patent: May 26, 1987

[54] MAGNETIC CIRCUIT FOR PERIODIC-PERMANENT-MAGNET FOCUSED TWTS

[75] Inventor: Kurt Amboss, Pacific Palisades, Calif.

[73] Assignee: Hughes Aircraft Company, Los Angeles, Calif.

[21] Appl. No.: 768,397

[22] Filed: Aug. 21, 1985

[51] Int. Cl.[4] ..... H01J 25/34

[52] U.S. Cl. ..... 315/3.5; 315/5.35; 315/37.3

[58] Field of Search ..... 315/3.5, 3.6, 5.35, 315/39.3

[56] References Cited

U.S. PATENT DOCUMENTS

| | | | |
|---|---|---|---|
| 3,324,339 | 6/1967 | Winslow et al. | 315/5.35 |
| 3,355,622 | 11/1967 | Bradford | 315/3.5 |
| 3,644,771 | 2/1972 | Kennedy et al. | 315/3.5 |
| 3,958,147 | 5/1976 | Triplett | 315/5.35 |
| 4,103,207 | 7/1978 | Chaffee | 315/3.5 |
| 4,307,322 | 12/1981 | Chaffee et al. | 315/3.5 |
| 4,414,486 | 11/1983 | Tsutaki et al. | 315/3.5 |

*Primary Examiner*—Saxfield Chatmon

*Attorney, Agent, or Firm*—Terje Gudmestad; Paul M. Coble; A. W. Karambelas

[57] ABSTRACT

An improved pole piece structure for periodic-permanent-magnet focused traveling wave tubes is disclosed. In one embodiment, the pole pieces have two fold symmetry and the magnets are arranged about the tube axis in a pattern with two-fold symmetry. This structure accommodates the input or output waveguides while maintaining the symmetry of the magnet placement. This allows the electron beam to remain centered on the tube axis and, therefore, minimizes beam interception. Circuit heating is reduced and the power handling margin of the tube is increased in comparison to conventional TWT structures. In another embodiment, a triangular pole piece configuration is employed, eliminating displacement of the magnets at the coupler and sever cavities and providing a third cooling channel.

8 Claims, 8 Drawing Figures

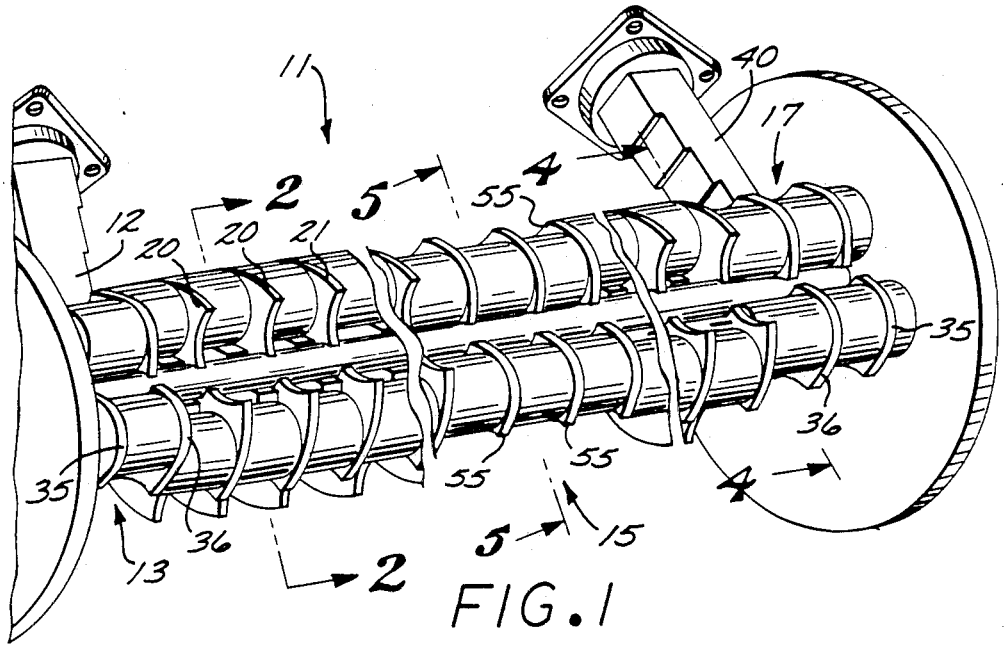
FIG. 1
FIG. 2
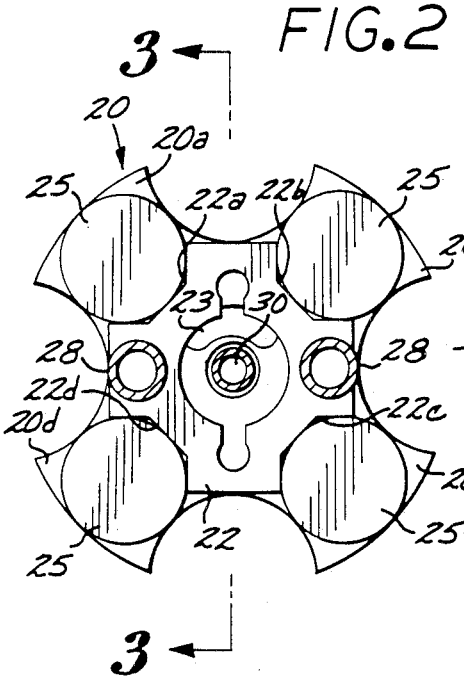
FIG. 3
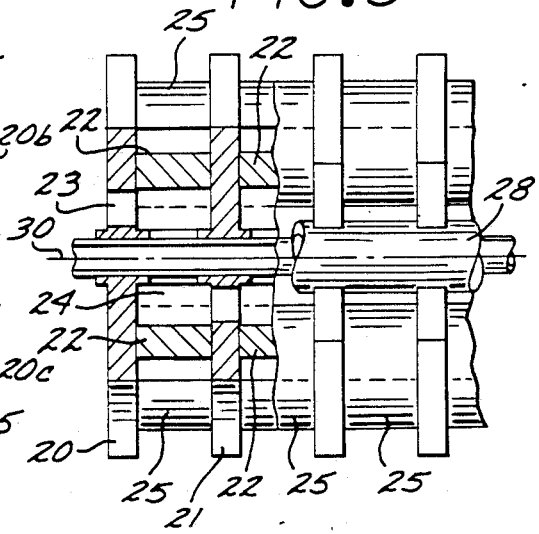

FIG. 8
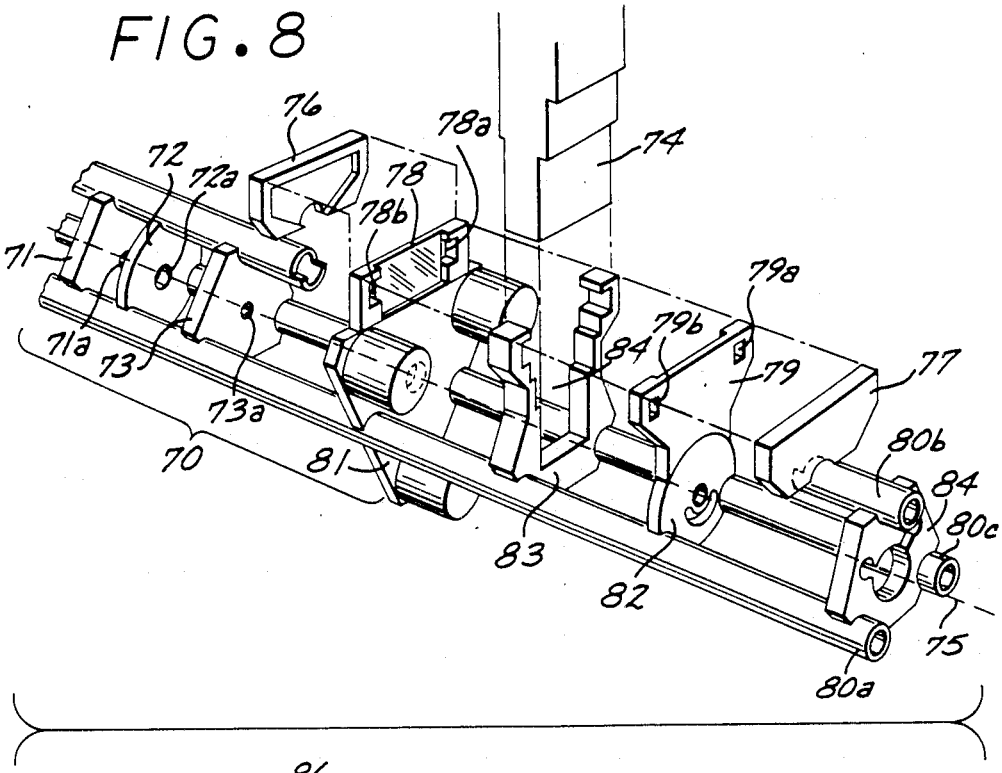
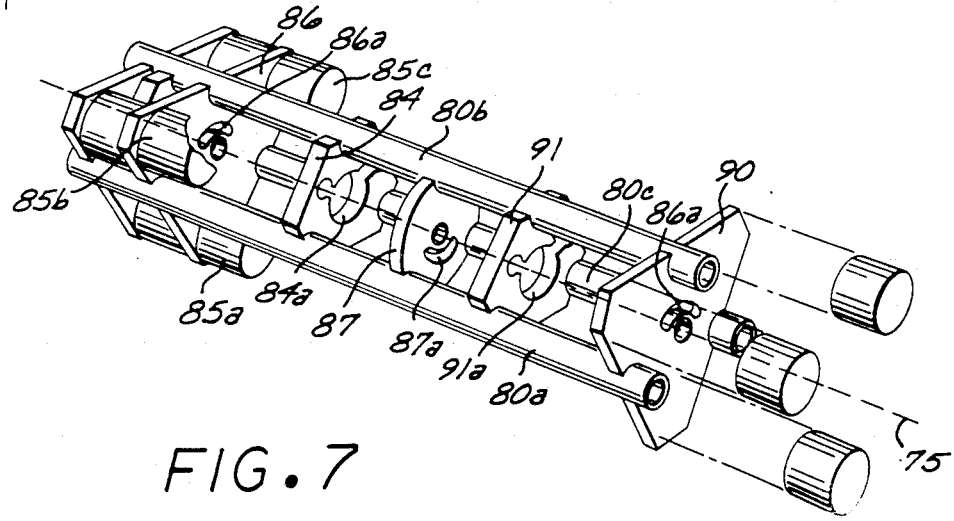
FIG. 7

MAGNETIC CIRCUIT FOR PERIODIC-PERMANENT-MAGNET FOCUSED TWTS

BACKGROUND OF THE INVENTION

The present invention relates to periodic-permanent-magnet (PPM) focused traveling wave tubes (TWTs), and more particularly to improvements to the magnetic circuits of such devices.

A conventional PPM TWT comprises a plurality of pole pieces, which have the dual functions of providing the magnetic field for focusing the electron beam and forming parts of the tuned r.f. cavities of the TWT. In a typical example, the magnetic field is produced by a periodic series of sets of four cylindrical Samarium-Cobalt magnets which are arranged in a pattern about the beam axis with four-fold symmetry. The symmetrical arrangement of the magnets in a set is disturbed in cavities where the r.f. energy is fed in or removed; these are known as the coupler and sever cavities. The r.f. energy is typically fed in or removed from the coupler cavities through reduced height waveguide sections. The sever cavities are typically filled with a lossy ceramic material having a width about equal to the width of the waveguide sections, and serve to attenuate the r.f. signal to enhance the stability of the TWT operation.

In a conventional PPM TWT, to accommodate the waveguide elements at the coupler cavities and the lossy ceramic material at the sever cavities, the Samarium-Cobalt magnets are displaced asymmetrically from the nominal positions having four-fold symmetry and protrude to varying degrees over the outward edges of the pole pieces. This magnet rearrangement reduces the magnetic field on the tube axis and introduces undesirable transverse magnetic field components which deflect some of the electrons into the sides of the circuit. Circuit heating is increased as a result of the beam interception, and the power handling margin of the tube is decreased. Further, the power output of the tube is decreased since the electrons which are intercepted no longer interact with the r.f. circuit.

Currently, the performance of virtually every PPM TWT needs to be improved by shunting. This procedure involves the placement of small rectangular strips of iron at experimentally determined locations along the magnetic circuit to compensate for the departure from rotational symmetry produced by the magnetic misalignment at the coupler and sever cavities and by other defects. The need for shunting arises primarily from transverse mechanical misalignments and magnetic inhomogenieties.

It would therefore represent an advance in the art to provide a magnetic circuit for a PPM TWT which has its rotational symmetry only minimally disturbed by the couplers and severs.

It would further be advantageous to provide a magnetic circuit for a PPM TWT which allows the electron beam to remain centered on the tube axis, minimizes beam interception and the amount of shunting required to align the beam on the tube axis, reduces circuit heating and increases the power handling margin of the TWT.

SUMMARY OF THE INVENTION

An improved pole piece geometry for PPM traveling wave tubes is disclosed. In accordance with the invention, pole pieces are employed at the coupler and sever cavities which accommodate the respective waveguide transformers and the lossy materials with minimal loss of rotational symmetry in the positioning of the magnets. In one embodiment, conventional pole pieces with four-fold symmetry are employed in the circuit section with sets of four permanent magnets, except at the coupler and sever cavities, where modified pole pieces are employed. The modified pole pieces are adapted to position magnets in a symmetrical relationship while accommodating the respective waveguide section in the coupler cavity or the lossy material in the sever cavity. In this arrangement the pole pieces have two-fold symmetry, thus minimizing the formation of undesirable transverse magnetic fields. In an alternative embodiment, a triangular pole piece configuration is employed with the three magnets of the magnet set disposed at the vertices of the triangular pole pieces. This pole piece configuration produces a magnetic field with little or no undesirable transverse magnetic field components, and permits the use of three cooling channels instead of the usual two channels provided by conventional arrangements.

BRIEF DESCRIPTION OF THE DRAWINGS

These and other features and advantages of the present invention will become more apparent from the following detailed description of exemplary embodiments thereof, as illustrated in the accompanying drawings, in which:

FIG. 1 is a perspective view of a circuit section of a PPM TWT employing modified pole pieces at the couplers and severs in accordance with the invention.

FIG. 2 is a cross-sectional view of the circuit section of FIG. 1 taken along line 2—2 therein, illustrating the conventional pole piece configuration and additionally a new spacer for registering the positions of the magnets in accordance with the invention.

FIG. 3 is another cross-sectional view illustrating the conventional pole piece configuration, taken along line 3—3 of FIG. 2.

FIGS. 7 and 8 are perspective views of an alternate embodiment of the invention employing three-fold rotational magnetic symmetry in a doubly periodic PPM TWT.

DETAILED DESCRIPTION OF THE DISCLOSURE

Figure 4:
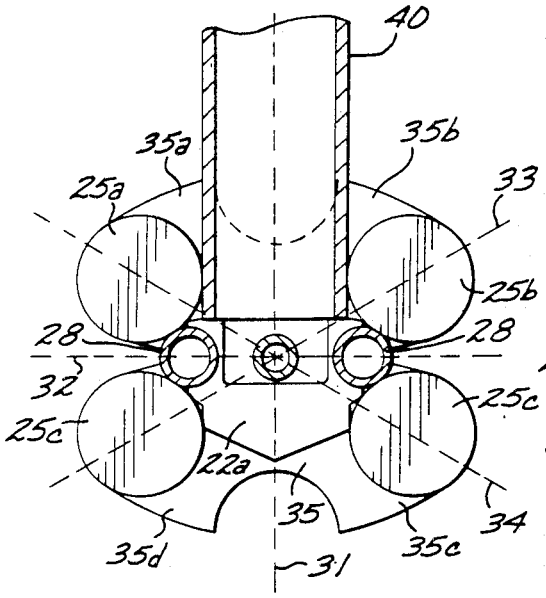
FIG. 4 is another cross-sectional view of the circuit section FIG. 1 taken through the coupler cavity along line 4—4, illustrating a modified pole piece configuration in accordance with the invention.

FIG. 1 is a partial perspective view of a circuit section 11 of a PPM TWT which employs a symmetrical placement of the magnets at the coupler and sever cavities in accordance with the invention. The general structure of the TWT is conventional, wherein a plurality of iron pole pieces in combination with alternating copper spacers define coupled r.f. cavities. Thus, in FIG. 1 an input waveguide 12 is coupled to a coupler cavity of the TWT (indicated generally by reference numeral 13) which is defined by a pair of pole pieces 35 and 36 and a spacer element 22*a* (shown in FIG. 4). One sever cavity is indicated generally by reference numeral 15. The output waveguide 40 is coupled to a coupler cavity adjacent the opposing end of the circuit section 11 from the input waveguide 12.

As is well known in the art, the TWT comprises an electron beam source (not shown) for generating an electron beam which traverses the circuit section 11 in alignment with the tube axis 30 (FIGS. 2 and 3). A magnetic field set up by the magnetic circuits comprising the tube focuses the beam to pass through the beam openings defined in the spacers and pole piece elements. An r.f. input signal is provided as an input signal through an input transformer comprising the input waveguide and is amplified through interaction with the electron beam. The r.f. signal is propagated through the respective r.f. cavities of the device to the output coupler cavity, where the output waveguide conducts the r.f. signal out of the tube. One or more sever cavities 15 are typically disposed along the circuit section intermediate the input and output cavities. The sever cavities are filled with lossy material which attenuates the r.f. signal to maintain stable operation of the tube.

The cross-sectional views of FIGS. 2 and 3 illustrate the configuration of conventional pole pieces. The conventional iron pole piece 20 has four-fold symmetry, with its four lobes 20*a*–20*d* extending symmetrically out at 90° intervals about the beam axis 30. Four Samarium-Cobalt magnets 25 are disposed between respective corresponding poles of adjacent pole pieces 20 and 21. The pole pieces 20, 21 and the spacer 22 define an r.f. cavity 24. The electron beam is passed along the center axis 30 of the TWT and is focused by the magnetic field set up by the magnetic circuit. The iron pole piece 20 has a coupling slot 23 formed therein to enable r.f. energy to be coupled from one r.f. cavity to the adjacent r.f. cavity and the energy is thereby propagated along the tube.

A pair of copper coolant tubes 28 extend parallel to the TWT axis 30 outside the r.f. cavities, and are employed to carry a coolant fluid to cool the tube during operation. The tubes 28 fit into corresponding openings formed in the pole pieces and spacer elements.

The magnetic circuit of the tube comprises sets of four cylindrical Samarium-Cobalt magnets 25 and the iron pole pieces such as pole piece 20. The magnets 25 are arranged with rotational symmetry about the tube axis to minimize any perturbing transverse magnetic field which would impart to the electron beam an undesirable transverse motion. The iron pole pieces have high permeability and are in magnetic contact with the magnets 25 to concentrate the magnetic field in the region of the beam axis 30. The copper spacers 22 are of low permeability and do not substantially affect the magnetic field.

The above-described structure is typically replicated to form the magnetic and r.f. circuit section of the tube. At the coupler cavities of the tube, r.f. energy is coupled into or out of the cavities by reduced height waveguide sections. In a PPM TWT employing a conventional pole piece geometry, two of the four magents must be displaced from their typical symmetrical position to accommodate the width of the waveguide as illustrated by the dashed line representation of a conventional pole piece in FIG. 6. The lossy material disposed in the sever cavities is typically a ceramic material 56 (shown in FIG. 5) having a width about equal to the waveguide width, and similarly requires displacement of the magnets from a symmetrical position about the sever cavities. This displacement imbalances the magnetic field, since two magnets now extend out above the pole pieces, and their magnetic field contribution is substantially reduced, while the magnetic field contribution from the non-displaced magnets remains the same. As a result, non-rotationally symmetric components of the magnetic field transverse to the TWT axis 30 are created, tending to cause undesirable deflection of the electrons away from the TWT axis. These non-rotationally symmetric transverse field components shall be referred to as perturbing field components. In accordance with the invention, modified pole pieces are employed at the coupler and sever cavities. These new pole pieces accommodate the waveguide and lossy ceramic material with minimal transverse magnetic fields.

FIG. 4 is a cross-sectional view taken through line 4—4 of FIG. 1, illustrating the geometry of the new pole pieces 35 and 36 at a coupler cavity. Instead of being disposed at equal 90° spacings about the TWT axis 30, the four poles 35*a–d* of the modified pole piece, for example, 35 are displaced a sufficient offset from the equidistant spacing to allow the magnets to accommodate the width of the waveguide or lossy ceramic material in the respective coupler and sever cavities. A typical outer width dimension for X-band waveguide is one inch. If the waveguide is to be received between magnets corresponding to poles 35*a* and 35*b*, each of these poles is azimuthally displaced away from the conventional equidistant location by one-half the additional offset spacing needed to accommodate the waveguide or the lossy ceramic material. To achieve two-fold symmetry, the other two poles 35*c* and 35*d* are displaced from the equidistant configuration by the same offset dimension.

It is apparent that the modified pole piece 35 has symmetry about the horizontal axis 32 and the vertical axis 31 as illustrated in FIG. 4. The pole piece 35 lacks symmetry about the axis 33 and 34 drawn through the opposing poles. In contrast, the conventional pole piece 20 illustrated in FIGS. 2 and 3 does have symmetry about the axis drawn through the opposing poles, as well as symmetry about the horizontal and vertical axis.

Figure 5:
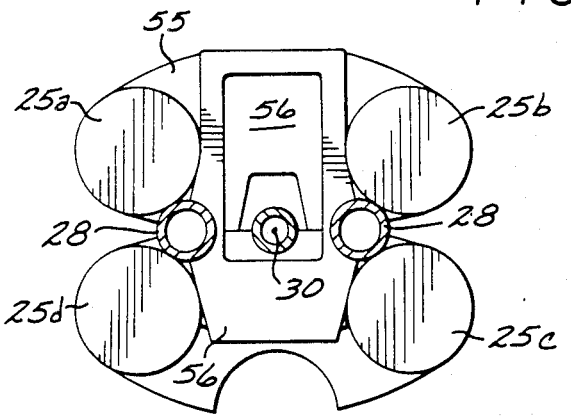
FIG. 5 is a cross-sectional view taken through the sever cavity 5 along line 5—5 of FIG. 1, illustrating a modified pole piece configuration in accordance with the invention.

FIG. 5 illustrates the modified pole piece 55 and corresponding spacer element 56. The configurations of elements 55 and 56 are similar to those of elements 35 and 22*a* shown in FIG. 4, with the spacer 56 adapted to register the positions of the magnets 25*a–d*, and the poles being azimuthally offset to accommodate the width of the lossy material 56 employed at a sever cavity.

The specific configuraion of the pole pieces 35 and 55 may, of course, vary in dependence on the dimensions of the waveguide, the lossy element and the TWT elements. The general principle is to provide a pole piece geometry which achieves the highest degree of symmetry of the magnet placement while accommodating the waveguide. The embodiment of the pole pieces illustrated in FIGS. 4 and 5 accomplishes this result.

Figure 6:
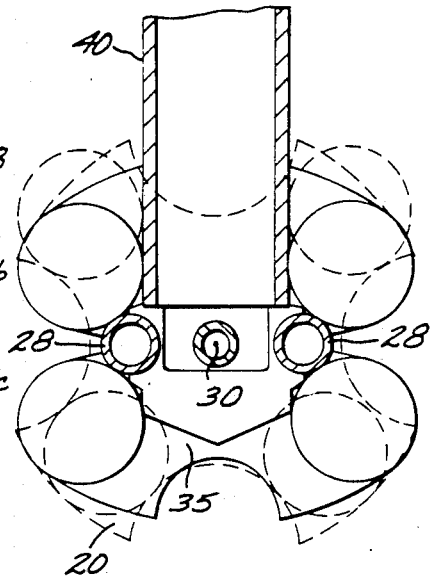
FIG. 6 is a cross-sectional depiction of a PPM TWT, taken though a coupler cavity and showing the relative configuration of a conventional pole piece (dashed line) and the pole piece configuration (solid line) in accordance with the invention.

FIG. 6 is a frontal view illustrative of the respective configurations of a new pole piece 35 (solid line) and a conventional pole piece 20 (dashed line) at a coupler cavity, with the corresponding placement of the magnets in respective solid and dashed lines. A waveguide section 40 is also depicted in FIG. 6. It should be apparent that the geometry of the modified pole piece 35 accommodates the waveguide 40 without displacement of the magnets from their symmetrical positions relative to the tube axis 30. Similarly, the novel pole piece configuration is used at the sever cavities to accommodate the lossy ceramic materials in the sever cavities without asymmetric dislocation of the magnets.

Another aspect of the invention is the novel spacer element 22, which comprises position registration surfaces for accurately positioning the magnets. As shown in FIG. 2, the corners of the spacer 22 are notched out to define relieved areas 22*a*–22*d* contoured to receive the respective magnets. Once the magnets are positioned against the surfaces of the spacer 22 defining the relieved areas 22*a*–22*d*, the magnets are typically glued in position. The positive registration of the magnet positions ensures that the magnets will be secured in the symmetric arrangement about the axis 30 to achieve the desired magnetic field. A spacer having similar magnet positioning surfaces is used to space the modified pole pieces 35 and 36; the spacer is, of course, configured to position the magnets in the arrangement having two-fold symmetry discussed above.

The modified pole pieces could be used in the construction of the entire circuit section of the TWT and the conventional pole pieces eliminated. However, the magnetic circuits with the conventional pole pieces do provide a stronger and more symmetrical magnetic field and are, therefore, retained in the circuit except at the coupler and sever cavities. Moreover, the conventional pole pieces are somewhat simpler and less expensive to fabricate than the modified pole pieces. For these reasons, it is presently considered desirable to use the conventional pole pieces except at the sever and coupler cavities.

FIGS. 7 and 8 illustrate an alternate embodiment of the invention. The alternate embodiment illustrates a pole piece arrangement known as doubly periodic permanent magnet focusing (DPPM), in which large and small pole pieces alternate. As illustrated in FIGS. 7 and 8, the large pole pieces have three-fold symmetry and the small pole pieces have rotational symmetry, neglecting the presence of the kidney-shaped coupling apertures. With the three magnets at the vertices of an equilateral triangle, no transverse magnetic field is produced.

In accordance with the invention, the large pole pieces are in the general shape of an equilateral triangle with the cooling channels bisecting respective sides of the triangle. This embodiment employs a plurality of sets of three magnets with the same pole piece geometry throughout the circuit and, therefore, does not involve displacement of the magnets at the coupler and sever cavities. A further advantage of the geometry of the illustrated embodiment is that it permits the addition of a third cooling channel.

Instead of employing a magnetic circuit with four magnets per magnet set, this configuration employs only three magnets in each cell of the magnetic circuit. To achieve the same magnetic field as that provided by a four magnet circuit, the three magnets are somewhat larger in diameter. By way of example, in experimental investigations of the axial component of the magnetic field for a 50 kW TWT requiring about 2250 gauss of peak magnetic field, it was found that the same axial field was produced by three 0.675 inch diameter Samarium-Cobalt magnets as by four 0.60 inch diameter magnets.

FIG. 7 is an exploded perspective view, illustrating the arrangement of the pole pieces, spacers and magnets in the stack comprising a typical circuit section of the TWT. Sandwiched between the large pole piece 86 and 90 is a copper spacer element 84 with a cavity opening 84*a* defined therein, a small iron pole piece 87 with a coupling slot 87*a* formed therein, and another copper spacer 91 with a cavity opening 91*a* formed therein. A set of three magnets 85*a*–85*c* are disposed between the respective large pole pieces 86 and 90. Thus, in each circuit section two r.f. cavities are defined between each pair of large pole pieces.

FIG. 8 is an exploded perspective view illustrating the geometry of the alternate embodiment in the region of the input transformer. In most traveling wave tubes, the input transformer has between it and the electron gun a dummy circuit section (without coupling apertures) known as the "beam scraper" 70 shown in FIG. 8. The beam scraper circuit 70 does not include any r.f. cavities, and comprises the triangular (iron) copper spacers 71 and 73 and the small circular iron pole piece 72 and two large pole pieces, one of which is shown in FIG. 8 as pole piece 81. Each of the elements 71, 72, 73 has a corresponding bore 71*a*, 72*a*, 73*a* formed in concentric alignment with the axis 75 of the tube to receive the electron beam.

The arrangement by which the input waveguide 74 is attached and by which the coolant line is led around the input transformer is shown in FIG. 8. The input waveguide 74 mates with matching copper spacer 83. A large iron pole piece 81 and a small iron pole piece 82 sandwich the matching spacer 83 and waveguide 74.

Three coolant tubes 80*a*, 80*b* and 80*c* are provided. Coolant tube 80*b* is interrupted by the input waveguide 74. To conduct the coolant around the periphery of the waveguide 74, a pair of copper coolant manifold elements 76 and 77 are fitted at the respective terminated ends of the coolant tube 80*b*. These respective elements are fitted against respective copper plenum elements 78 and 79 respectively brazed to the large triangular iron pole piece 81 and to the small iron pole piece 82. A copper matching spacer 83 fits between the respective large and small pole pieces 81 and 82 to define coupler cavity 84. Inlets 78*a*, 78*b* and 79*a*, 79*b* are formed in the respective plenum elements 78, 79 to conduct coolant around the input waveguide 74.

The third cooling channel provides additional cooling capacity to conduct heat away from the r.f. and magnetic circuits, thereby increasing the power handing capabilities of the TWT. With this novel configuration the same pole piece elements can be used throughout the tube, thus simplying its construction.

It is understood that the above-described embodiments are merely illustrative of the possible specific embodiments which can represent principles of the present invention. Other arrangements may be devised in accordance with these principles by those skilled in the art without departing from the scope of the invention.

What is claimed is:

1. An improved traveling wave tube employing periodic-permanent-magnet focusing of an electron beam along a tube axis, comprising:

a plurality of pole piece elements of a high permeability and each comprising three poles arranged in a substantially triangular configuration;

spacer means of a low permeability for separating said pole pieces;

a plurality of magnet sets comprising three cylindrical permanent magnet elements;

said pole pieces and said spacer means being aligned on said axis to comprise a stack defining coupled r.f. cavities and with said respective sets of magnets being arranged between corresponding poles of adjacent pole piece elements in a symmetrical arrangement about said tube axis to comprise a magnetic circuit;

whereby the configuration of said pole piece elements, spacer means and magnets accommodates waveguide elements at the coupler cavities and lossy material at sever cavities without displacement of the magnet elements from their symmetrical arrangement about the tube axis.

2. The traveling wave tube of claim 1 wherein said respective magnets of each magnet set are disposed between corresponding vertices of adjacent pole piece elements.

3. The traveling wave tube of claim 1 wherein said triangular configuration of said pole pieces is substantially equilateral.

4. The traveling wave tube of claim 1 further comprising three cooling channels disposed in substantially parallel alignment with said tube axis for conducting cooling fluid.

5. The traveling wave tube of claim 4 further comprising coolant manifold means for conducting coolant around said input and output waveguide elements without disturbing the respective r.f. circuits.

6. The traveling wave tube of claim 1 wherein said spacer means comprises surfaces for registering the positions of said magnets in said symmetrical arrangement about the tube axis.

7. A traveling-wave tube employing periodic-permanent-magnet focusing of an electron beam along a tube axis, comprising:

a plurality of pole piece elements of a high permeability, each pole piece having four extending poles;

a plurality of magnet sets each comprising four cylindical permanent magnets;

a plurality of spacers of low permeability for separating said pole pieces, each spacer having four notched out corners respectively defining four relieved areas contoured to receive respective ones of said magnets for accurately positioning said magnets in fourfold symmetry;

said pole pieces and said spacers being aligned on said tube axis to comprise a stack defining coupled r.f. cavities and with respective sets of magnets being arranged between corresponding poles of adjacent pole piece elements and registering against respective notched out corners on said spacers such that said magnets are positioned about said tube axis in fourfold symmetry.

8. An improved coupler or sever cavity magnetic circuit for traveling-wave tubes (TWT) employing periodic-permanent-magnet focusing of an electron beam along a tube axis, comprising:

two pole piece elements aligned on said tube axis, each pole piece element being made of high permeability material and having four extending poles each arranged in substantially twofold symmetry about mutually orthogonal axes through said tube axis;

four cylindrical permanent magnets disposed between corresponding extending poles of adjacent pole piece elements and arranged such that the axis of each cylindrical magnet is substantially parallel to said tube axis;

a spacer of low permeability for separating said pole pieces disposed between said pole pieces and aligned on said tube axis, said spacer having four notched out corners defining four relieved areas contoured to receive respective ones of said magnets such that said magnets are accurately positioned in twofold symmetry about said tube axis and are displaced axially to accommodate the width of a waveguide transformer or lossy material in a respective coupler or sever cavity.

* * * * *